US007338397B2

(12) United States Patent
Mizek et al.

(10) Patent No.: US 7,338,397 B2
(45) Date of Patent: Mar. 4, 2008

(54) ROTATABLE ARROWHEAD

(75) Inventors: Robert S. Mizek, Downers Grove, IL (US); Christopher A. Kozlik, Schaumburg, IL (US); Miroslav A. Simo, Riverside, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/345,831

(22) Filed: Jan. 16, 2003

(65) Prior Publication Data

US 2004/0142778 A1 Jul. 22, 2004

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS 3,910,579 A * 10/1975 Sprandel ..... 473/584
4,006,901 A 2/1977 Simo
4,175,749 A 11/1979 Simo
4,203,601 A 5/1980 Simo
4,381,866 A 5/1983 Simo
4,452,460 A * 6/1984 Adams ..... 473/584
4,468,038 A * 8/1984 Saunders ..... 473/584
4,671,517 A * 6/1987 Winters ..... 473/583
4,781,386 A * 11/1988 Armitage ..... 473/584
5,257,809 A * 11/1993 Carrizosa ..... 473/584
5,496,042 A * 3/1996 Craft et al. ..... 473/583
6,398,676 B1 6/2002 Mizek

* cited by examiner

*Primary Examiner*—John A. Ricci
(74) *Attorney, Agent, or Firm*—Pauley Petersen & Erickson

(57) ABSTRACT

A rotatable arrowhead having a blade-carrying body that rotates with respect to a shaft that is attached with respect to an arrow shaft. In one embodiment, the rotatable arrowhead has a body and a tip portion that preferably rotate together with respect to the shaft of the arrowhead. The shaft extends within a through bore of the body. A portion of the shaft has a peripheral retention groove about at least a portion of a periphery of the shaft. The tip portion accommodates a retainer. In an assembled condition of the arrowhead, the retainer is positioned within the retention groove. In another embodiment, the rotatable arrowhead has a body that rotates with respect to the shaft of the arrowhead. The shaft extends within the through bore of the body, either partially or completely. The retainer can be mounted within the body or the tip portion, depending upon whether or not the tip portion rotates with respect to the body.

44 Claims, 20 Drawing Sheets

ROTATABLE ARROWHEAD

BACKGROUND OF THE INVENTION

1. Field of the Invention

This invention relates to an arrowhead having a tip portion fixed with respect to a body, wherein the tip portion and the body either rotate together with respect to an arrow shaft or are fixed with respect to the arrow shaft.

2. Discussion of Related Art

Some conventional arrowheads have blades which rotate with respect to an arrow shaft. However, the conventional arrowheads have a tip portion fixed with respect to the arrow shaft and the blade-carrying body rotates with respect to the arrow shaft and the tip portion.

In conventional arrowheads, a blade-carrying body is mounted rotatably between a tip portion and an element, such as an adapter, mounted to the arrow shaft. The blade-carrying body rotates with respect to the arrow shaft but the tip portion or structure is fixed with respect to and thus does not rotate with respect to the arrow shaft.

U.S. Pat. Nos. 4,006,901, 4,175,749 and 4,203,601 disclose arrowheads wherein the blade-carrying body rotates with respect to both the arrow shaft and the tip structure, which are fixed with respect to each other.

There is an apparent need for a rotatable arrowhead that no longer requires a tip portion to be fixed with respect to the arrow shaft. Also, there is an apparent need for a rotatable arrowhead that can be easily manufactured and conveniently assembled and disassembled, for example to simplify parts replacement procedures.

SUMMARY OF THE INVENTION

It is one object of this invention to provide a rotatable arrowhead that has both a tip portion and a blade-carrying body that rotate together with respect to the arrow shaft.

It is another object of this invention to provide a rotatable arrowhead that can be easily assembled and disassembled, particularly for interchanging or replacing blades.

The above and other objects of this invention are accomplished with a rotatable arrowhead having a body, such as a blade-carrying body, which has a through bore or a closed bore. A shaft is adapted, such as with an externally threaded shaft, to a conventional and standard receiver which is fixed with respect to any one of different conventional and standard arrow shafts. The shaft extends within the through bore. A shaft portion of the shaft extends beyond an end portion of the body.

The shaft portion has a peripheral retention groove and/or ridge that extends about at least a portion of a periphery of the shaft portion.

A tip portion is rotatably mounted with respect to the shaft.

A retainer, such as a pin, a set screw or another suitable projection, extends within the retention groove of the shaft portion. In an assembled condition of the arrowhead, with one or more projections extending within the retaining groove and/or about a ridge, the tip portion has limited longitudinal movement with respect to the shaft. In one embodiment of this invention, a bias element is positioned with respect to the shaft, to urge the tip in a forward direction. The bias element, such as a compressible washer or a wave washer, forces the pin, set screw or other suitable projection to contact a forwardmost shoulder defining the retention groove.

In one embodiment of this invention, a blade is detachably mounted with respect to the body and the tip portion. For example, the blade can be mounted within a slot of the tip portion and within one or more slots of the body. The blade can fix the relative position of the tip portion with respect to the body and thus cause the tip portion and the body to rotate together with respect to the shaft.

In another embodiment of this invention, at least one blade is integrated with the body, to form a unitary structure of the body and each blade. The shaft portion having the retention groove can either extend beyond a forwardmost part of the body or can be contained within the through bore of the body. If contained within the through bore of the body, the retainer extends through a bore within the body. In the assembled condition of the body with respect to the shaft, the retainer fits within the retention groove. Thus, the body can be rotatably mounted with respect to the shaft, with limited movement in the longitudinal direction. The tip portion can be fixed with respect to the body.

BRIEF DESCRIPTION OF THE DRAWINGS

The features of this invention can be better understood when this specification is read in view of the drawings, wherein.

DETAILED DESCRIPTION OF PREFERRED EMBODIMENTS

Figure 1:
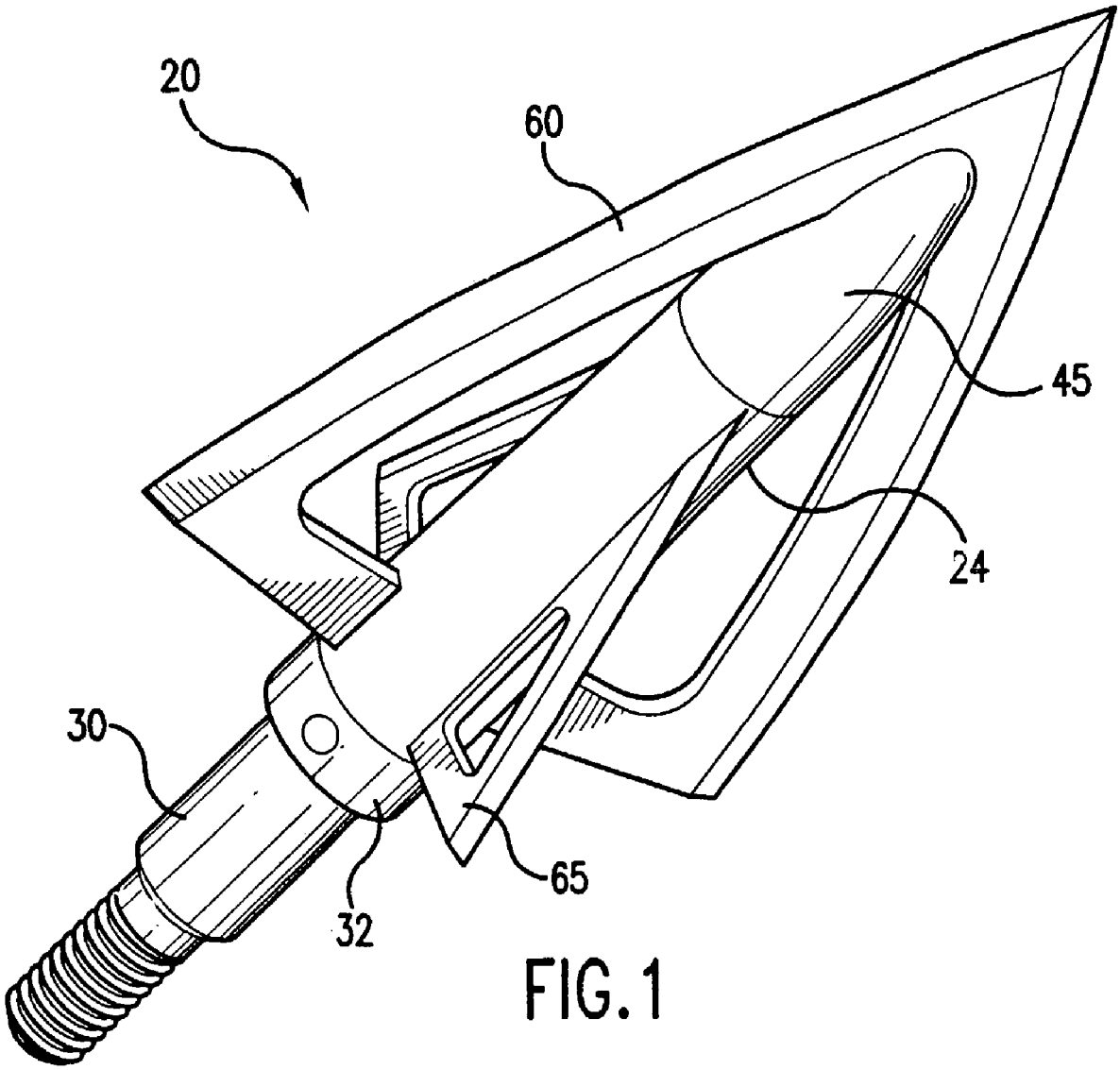
FIG. 1 is a perspective view of an assembled rotatable arrowhead, according to one embodiment of this invention.
Figure 2:
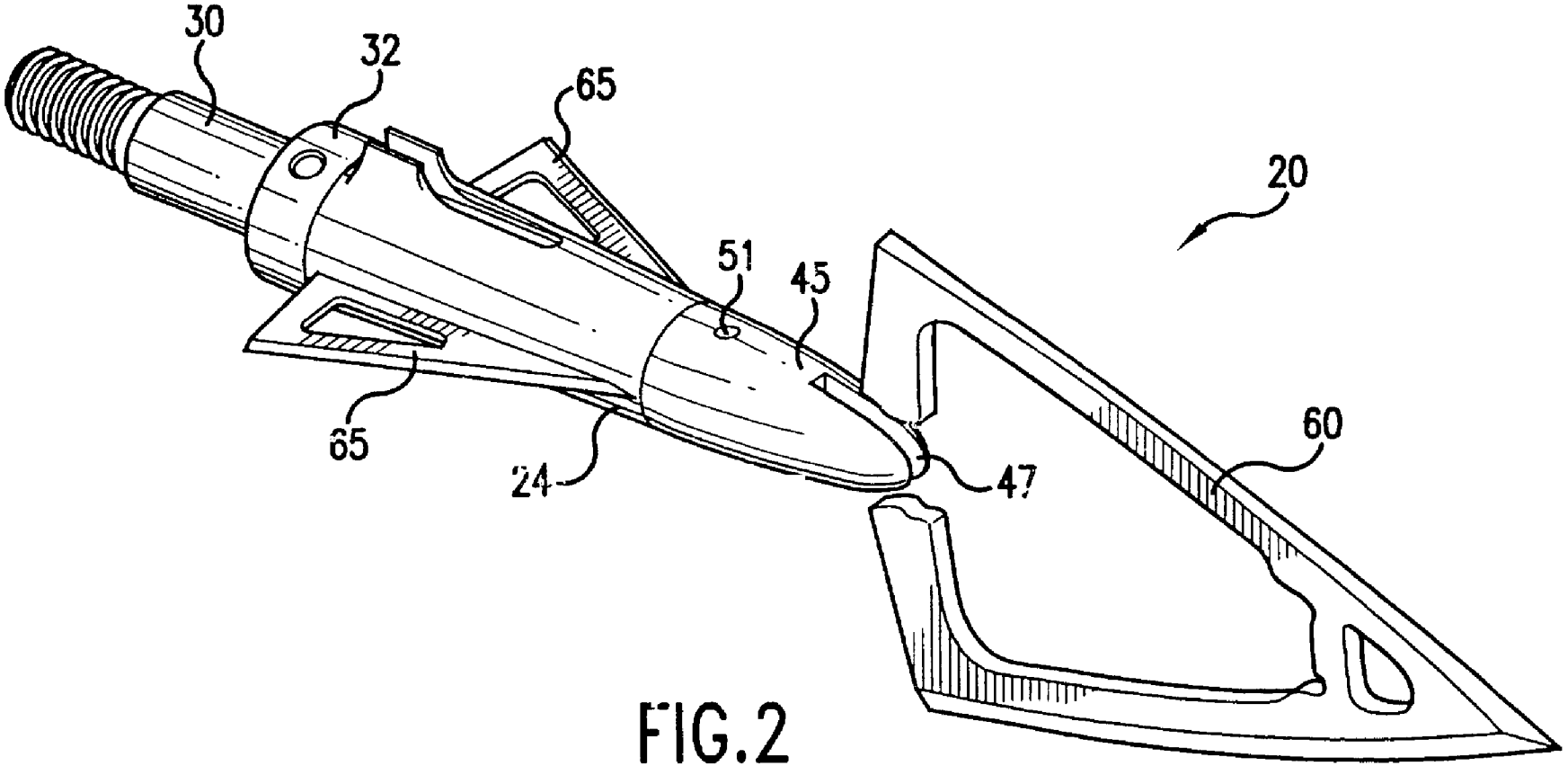
FIG. 2 is a perspective view of the rotatable arrowhead shown in FIG. 1, with a blade removed with respect to a tip portion and a body of the arrowhead.

FIG. 1 shows a perspective view of a completely assembled rotatable arrowhead 20, according to one embodiment of this invention. Certain elements and their relationship with respect to each other, according to this invention, are taught by U.S. Pat. Nos. 4,006,901, 4,175,749 and 4,203,601, each issued to Miroslav A. Simo, the entire teachings of which are incorporated into this specification by reference to such United States Patents.

As shown in FIG. 1 according to this invention, and as discussed further in the following specification, except for the amount of mechanical play between elements resulting from manufacturing tolerances and design clearances, blade 60 fixes the position of tip portion 45 with respect to body 24. Thus, in certain embodiments, both tip portion 45 and body 24 rotate together with respect to shaft 30.

Figure 3:
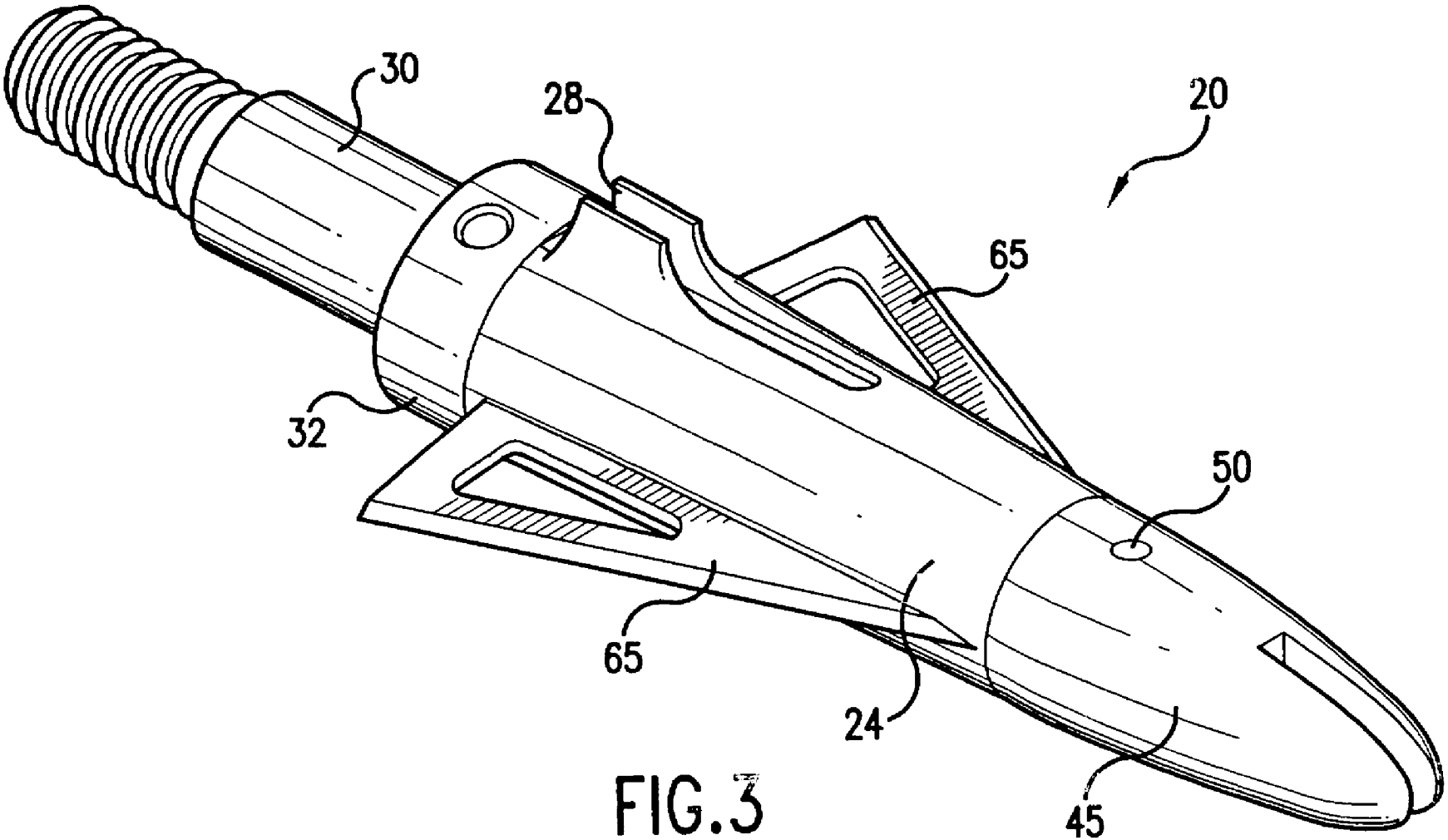
FIG. 3 is a perspective view of an assembled shaft, blade and tip portion, according to one embodiment of this invention.

In one embodiment of this invention, body 24 has through bore 26, as shown in FIGS. 4, 5 and 7-10. As shown between FIGS. 3, 6 and 7, in an assembled position, shaft 30 extends within through bore 26. In an assembled condition of such embodiment, shaft 30 has a forward shaft portion 35 that extends beyond end portion 29 of body 24.

As used throughout this specification and in the claims, the terms forward and rearward relate to a front and a rear of arrowhead 20, relative to a direction of flight of an arrow shaft to which arrowhead 20 is attached, in a conventional manner.

As shown in FIGS. 4-7, shaft portion 35 has peripheral retention groove 37 that extends about at least a portion of a periphery of shaft portion 35. Preferably, but not necessarily, retention groove 37 extends completely about the periphery of shaft portion 35. Retention groove 37 can also extend about at least a portion of body 24. As shown in FIGS. 4-7, retention groove 37 has a generally rectangular cross section. However, retention groove 37 may have any other suitable cross section that accommodates retainer 50 or pin 51, as discussed in more detail throughout this specification. For example, retention groove 37 can have a semicircular cross section, a polygonal cross section or any other suitable cross section that may cause interference with longitudinal movement of retainer 50 with respect to shaft 30. Retention groove 37 can also be formed by one or more ridges formed on shaft portion 35.

Tip portion 45 and/or body 24 accommodates retainer 50, preferably so that projection 52 of retainer 50 fits within retention groove 37 to interfere with and thus limit longitudinal movement of tip portion 45 with respect to shaft 30. In one embodiment of this invention, retainer 50 comprises at least one pin 51 mounted within each of one or more through bores 48 of tip portion 45. For example, three or more retainers 50 provide additional structural strength to arrowhead 20 than one or two retainers 50.

Figure 7:
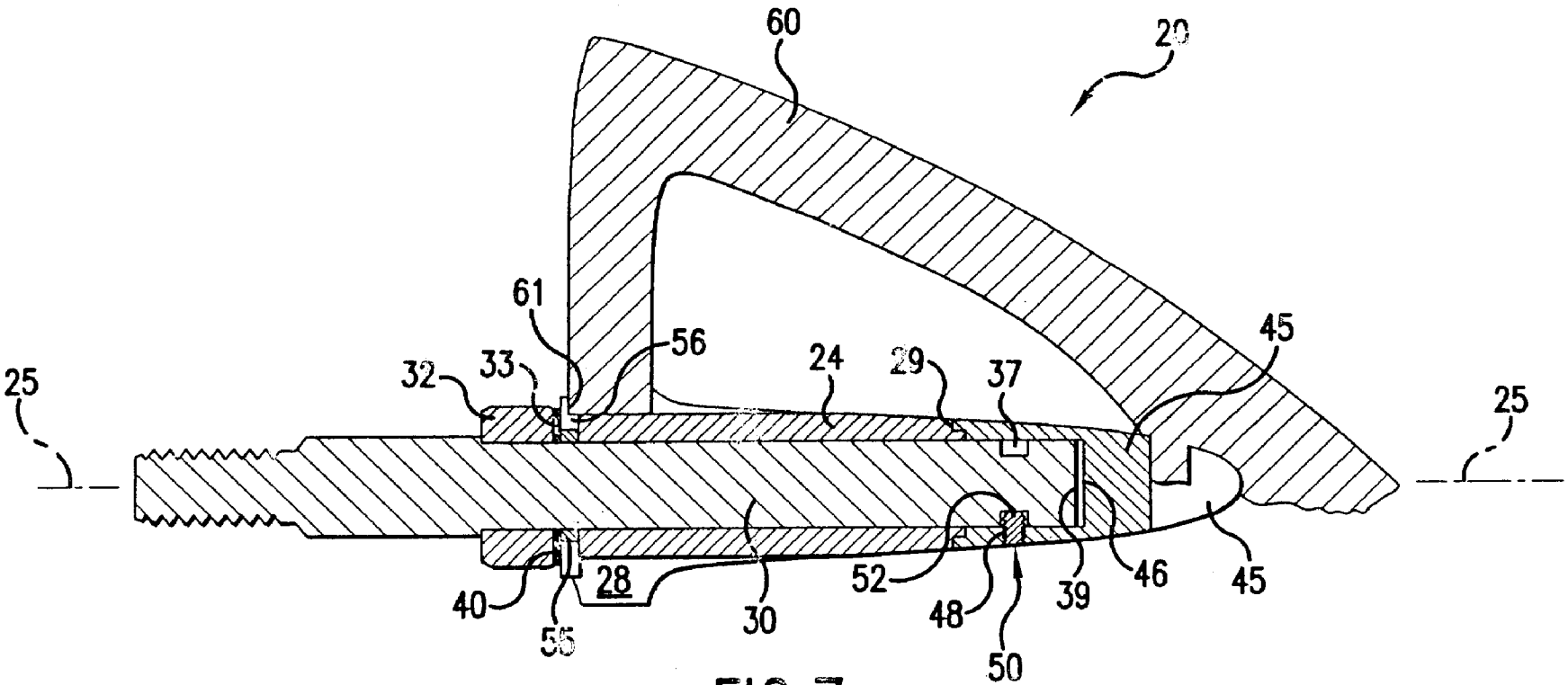
FIG. 7 is a sectional view taken along a longitudinal axis, of a portion of an arrowhead assembly, according to one embodiment of this invention.
Figure 8:
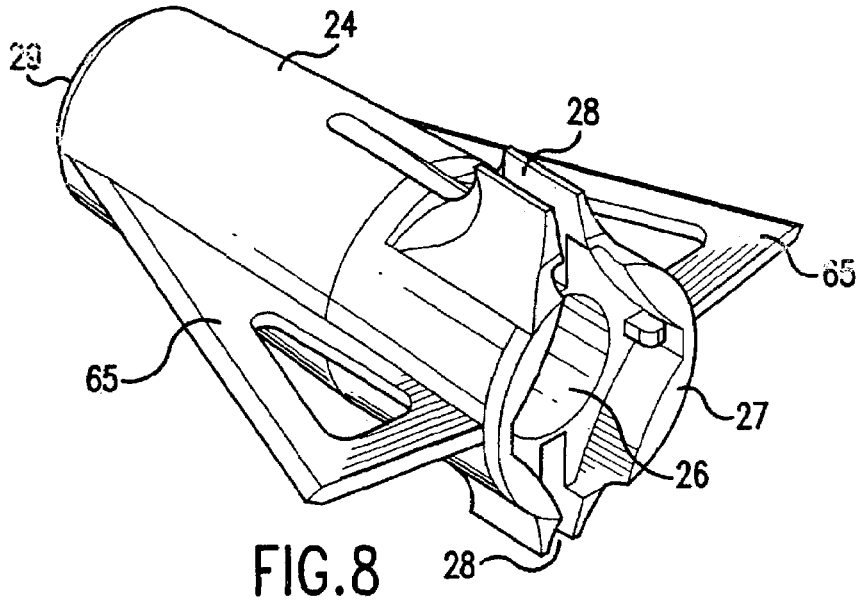
FIG. 8 is a perspective top view of a body or cartridge, according to one embodiment of this invention.
Figure 9:
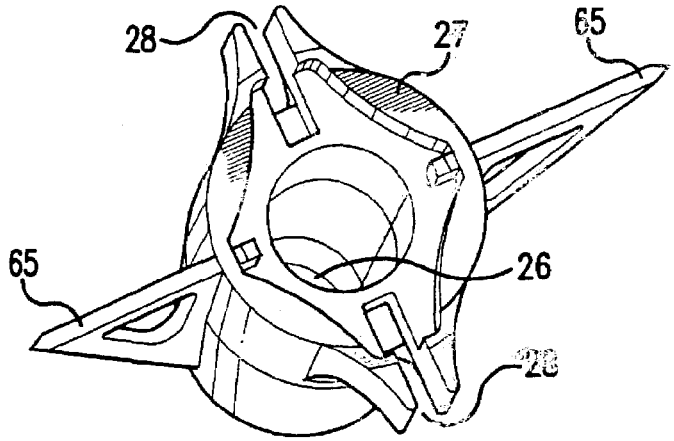
FIG. 9 is a perspective bottom view of the body or cartridge shown in FIG. 8.
Figure 10:
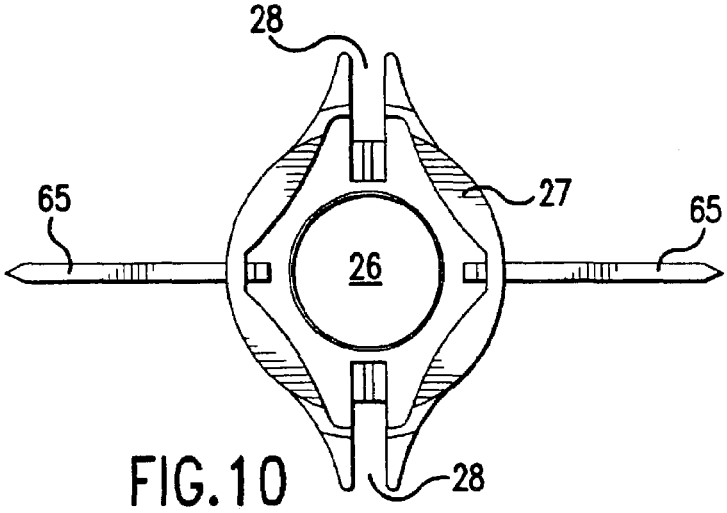
FIG. 10 is a rear view of the body or cartridge as shown in FIGS. 7 and 8.

In one embodiment of this invention, pin 51 is generally cylindrical and can be press-fitted, adhered or otherwise fixed within through bore 48 and with respect to tip portion 45. In another embodiment of this invention, for example as shown in FIG. 7, retainer 50 comprises a set screw having screw threads that engage with internal threads of through bore 48. In yet another embodiment of this invention, retainer 50 comprises projection 52, which may or may not be integrated with tip portion 45. For example, the material or structure of tip portion 45 can be machine punched to form projection 52. Regardless of the structure of retainer 50, with arrowhead 20 in an assembled condition, at least a portion of retainer 50 is positioned within retention groove 37, and when tip portion 45 is moved in a longitudinal direction, retainer 50 interferes with a shoulder, for example of shaft 30, defining retention groove 37.

As previously discussed, retention groove 37 can have any suitable cross section. Preferably, but not necessarily, the portion of retainer 50 that fits within retention groove 37 has a corresponding cross section that compliments or fits within retention groove 37. In one embodiment of this invention, tip portion 45 is urged in a forward direction until retainer 50 contacts the shoulder of retention groove 37. Thus, retention groove 37 and the portion of retainer 50 that fits within retention groove 37 preferably have complimentary cross sections that provide sufficient contact for interference purposes.

Figure 4:
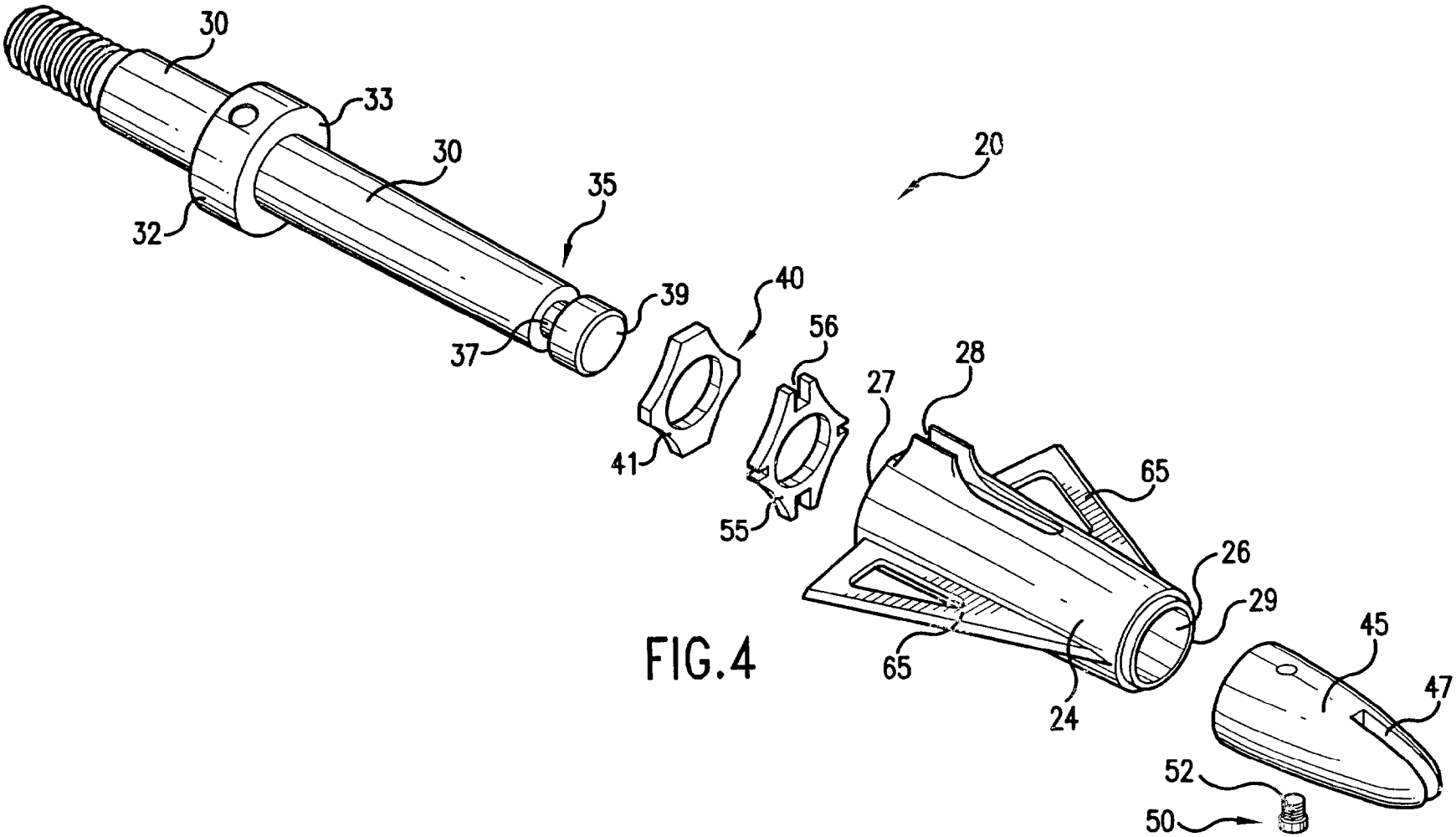
FIG. 4 is an exploded perspective front view of the arrowhead assembly shown in FIG. 3.
Figure 5:
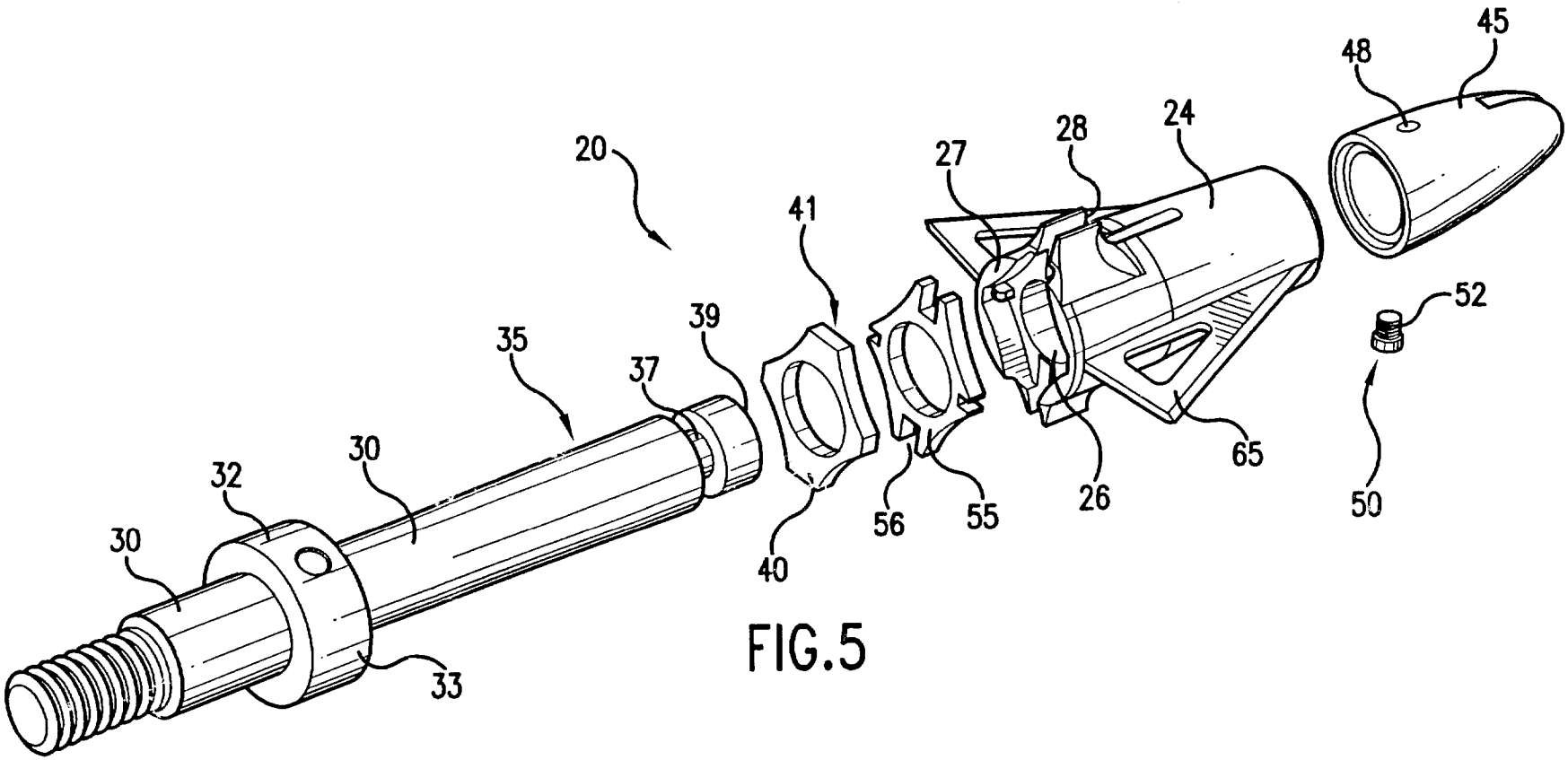
FIG. 5 is an exploded perspective rear view of the arrowhead assembly as shown in FIGS. 3 and 4.
Figure 6:
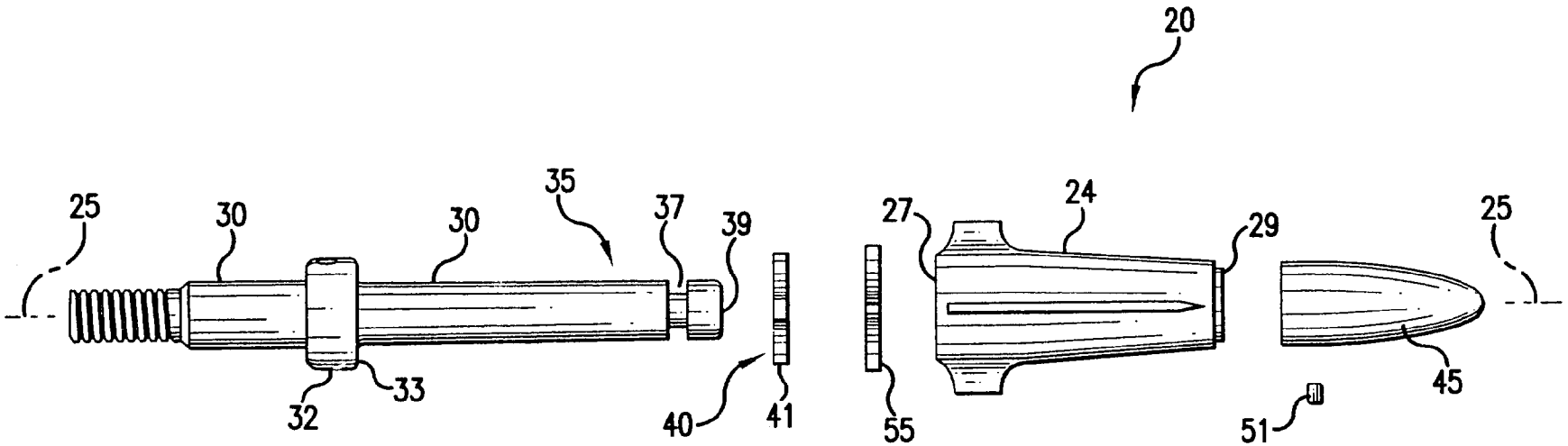
FIG. 6 is an exploded side view of the arrowhead assembly as shown in FIGS. 3-5.

In one embodiment of this invention, bias element 40 urges tip portion 45 in the forward direction. As shown in FIGS. 4-7, bias element 40 is positioned with respect to shaft 30, to urge body 24 toward tip portion 45. As shown in FIGS. 4-7, bias element 40 comprises washer 41, which is positioned about shaft 30 between shoulder 33 and rearward end 27 of body 24. Bias element 40 exerts a force, either directly or indirectly, that urges tip portion 45 and shaft 30 longitudinally apart from each other. As shown in FIGS. 4-6, shoulder 33 can be formed by collar 32, can be formed by another similar structure, or can be formed as an integrated part of shaft 30. As shown in FIGS. 4-7, collar 32 is detachably fixed with respect to shaft 30 using a set screw. However, collar 32 can also be fixed with respect to shaft 30 in any other suitable mechanical and/or structural manner. Collar 32 and/or shoulder 33 can also be integrated with shaft 30.

In one embodiment of this invention, washer 41 is constructed of a compressible material, such as a foam material, that has a bias force urging the compressed material back to its at rest condition. In another embodiment of this invention, washer 41 may comprise a wave washer or a lock washer that also has a bias force or tendency to return to its at rest condition when compressed. With washer 41 positioned between shoulder 33 and end surface 39 or any other suitable structure, washer 41 directly or indirectly urges body 24 in the forward direction towards tip portion 45, and thus takes up axial or longitudinal play between the elements of arrowhead 20. Any other suitable spring, washer or other bias element, either alone or in combination, can be used to accomplish the same result of reducing or eliminating axial or longitudinal play between elements of arrowhead 20.

In one embodiment of this invention, body 24 has an overall shape of a cartridge. As shown in FIGS. 4, 5 and 7, body 24 forms through bore 26. However, in other embodiments of this invention, bore 26 may be a closed bore, such as in the embodiment shown in FIGS. 11-13, for example when body 24 and tip portion 45 are integrated to form a one-piece structure, or if body 24 simply forms closed bore 26.

As shown in FIG. 6, in the assembled condition, elements of this invention are positioned along longitudinal axis 25 of body 24. In one embodiment of this invention, in a direction perpendicular to longitudinal axis 25, bore 26 of body 24 has a circular cross section. In one embodiment of this invention, at least a portion of shaft 30 has a cylindrical external surface. However, in other embodiments of this invention, the outer surface of at least a portion of shaft 30, which mates with bore 26 of body 24 has a shape and outer dimensions that correspond to the shape and inner dimensions of bore 26, to allow body 24 to rotate with respect to shaft 30.

In one embodiment of this invention, an outer diameter of at least a portion of shaft 30 is sized relative to an inner diameter of bore 26, to allow body 24 to freely rotate about shaft 30.

As shown in FIGS. 4-7, body 24 can rotate with 360° of freedom with respect to shaft 30. However, in other embodiments of this invention, it is possible to use flat surfaces, grooves or other structural shapes to limit the rotational movement of body 24 with respect to shaft 30 to less than 360° of freedom.

As shown in FIG. 7, in one embodiment of this invention, end surface 39 of shaft portion 35 is spaced at a distance from stop surface 46 of tip portion 45. Also as shown in FIG. 7, end portion 61 of blade 60 is spaced at a distance from shoulder 33, or another similar structure, which is fixed with respect to body 24. Thus, when arrowhead 20 is in use and strikes an object, an impact force moves blade 60 in a rearward direction until stop surface 46 contacts end surface 39 and thus allows tip portion 45 to bottom out on shaft 30. In such contact or bottom out position, a space is preferably maintained between end portion 61 of blade 60 and shoulder 33 of collar 32.

As shown in FIGS. 1 and 7, blade 60 has a rearward end mounted with respect to body 24 and a forward end mounted with respect to tip portion 45. As shown in FIGS. 1, 3, 5 and 7-10, body 24 forms slot 28 in which the rearward end portion of blade 60 is mounted. Tip portion 45 forms slot 47 in which the forward portion of blade 60 is mounted. Manufacturing tolerances and clearances can be designed so that when in a mounted position, blade 60 has no movement or relatively little movement, such as due to clearances and/or tolerances, with respect to body 24 and/or tip portion 45. Thus, with blade 60 in a mounted position, body 24, tip portion 45 and blade 60 form a rigid or relatively unitary structure which allows blade 60 to rotate together with body 24 and tip portion 45, all with respect to shaft 30.

In one embodiment of this invention, blade 60 retains tip portion 45 in a relatively fixed position with respect to body 24. Blade 60 is detachably mounted with respect to body 24 and with respect to tip portion 45. The detachable mounting provides easy assembly, disassembly and thus, for example, blade exchange or replacement.

As shown in FIGS. 4-7, retaining ring 55 is positioned about shaft 30, between body 24 and shoulder 33. As shown in FIGS. 4 and 5, retaining ring 55 has four blade retaining grooves 56, two which accommodate blade 60 and two which accommodate auxiliary blades 65. Auxiliary blades 65 are not necessary, but can be used to enhance penetration of arrowhead 20 within a target.

Retaining ring 55 may or may not be used throughout different embodiments of this invention. Retaining ring 55 can be used when blade 60 is exposed to relatively large forces, particularly forces that act upon arrowhead 20 to torque blade 60 with respect to longitudinal axis 25. Retaining ring 55 provides additional structural strength to hold the rearward portion of blade 60 and/or auxiliary blade 65.

Different combined features and/or elements, as discussed above, can be used to assemble arrowhead 20 according to this invention. Arrowhead 20 according to this invention can be used to rotate tip portion 45 with respect to shaft 30. During flight or in use, tip portion 45 rotates with respect to shaft 30. Body 24 is rotatably mounted about shaft 30 which extends within through bore 26. A relative position of tip portion 45 can be fixed with respect to body 24, to allow tip portion 45 and body 24 to rotate together with respect to shaft 30.

Figure 11:
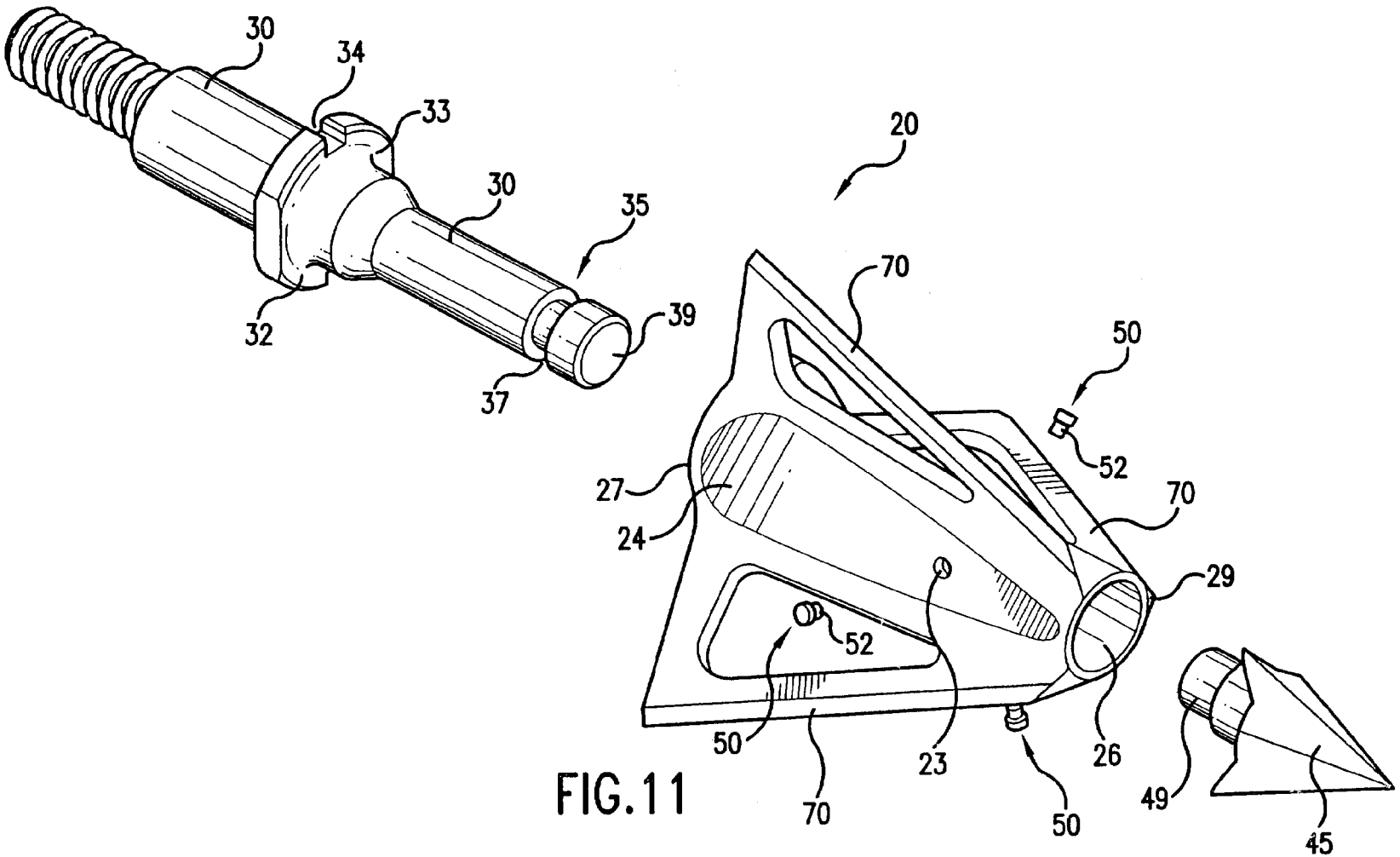
FIG. 11 is an exploded perspective front view of an arrowhead assembly, according to another embodiment of this invention.
Figure 12:
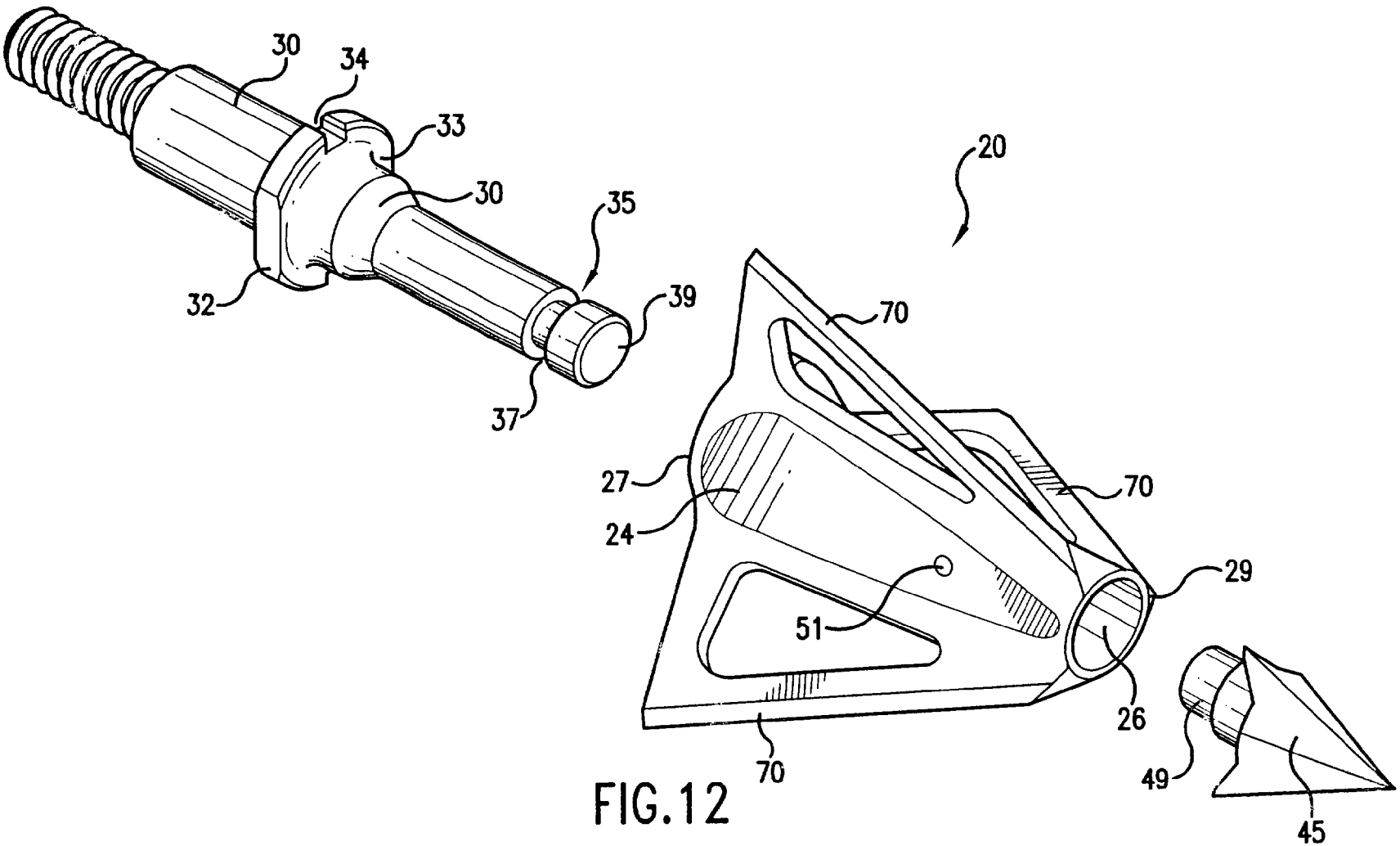
FIG. 12 is an exploded perspective front view of the arrowhead assembly as shown in FIG. 11, but with retainers in an assembled position with respect to a body of the arrowhead assembly.
Figure 13:
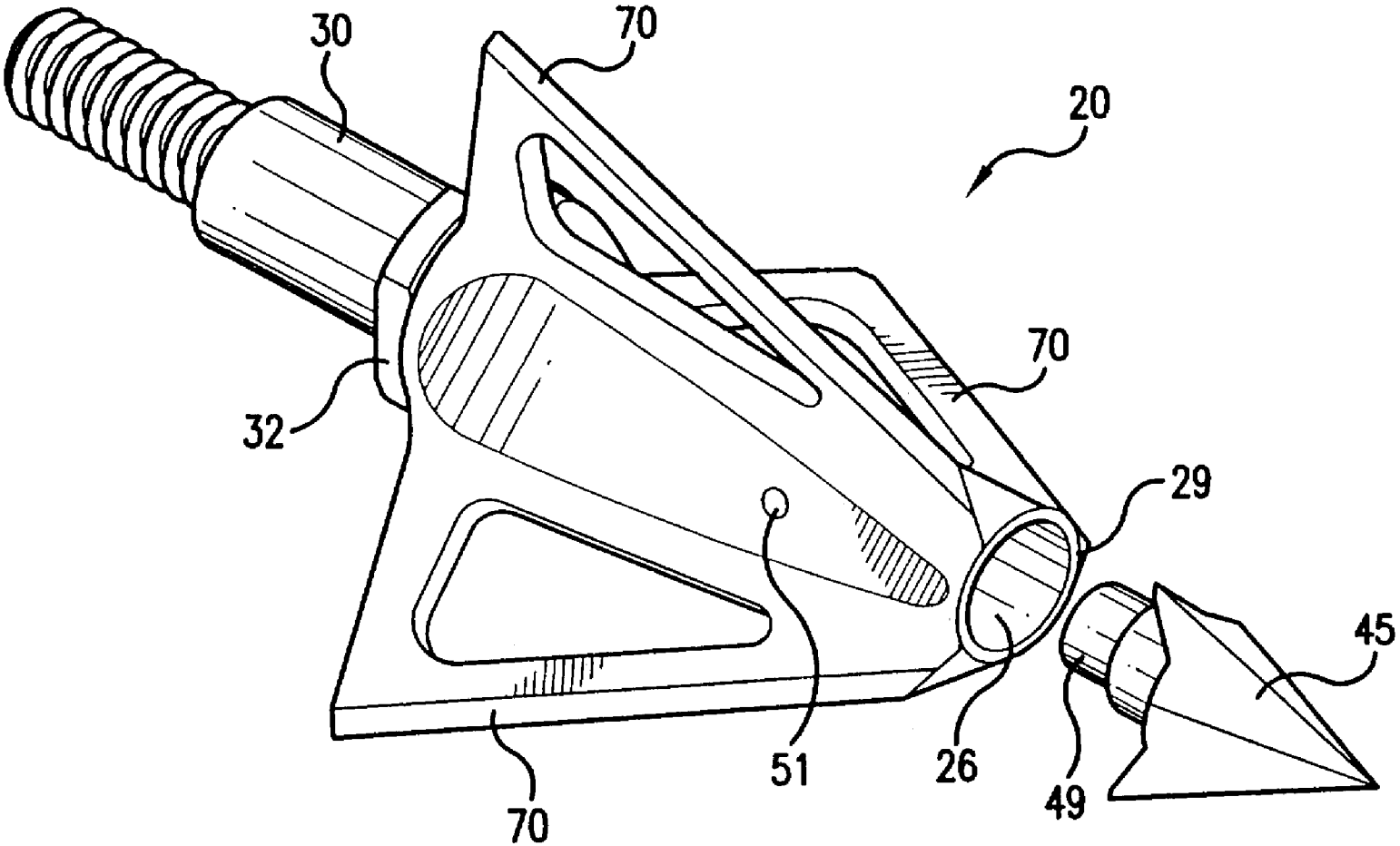
FIG. 13 is an exploded perspective front view of the arrowhead assembly as shown in FIGS. 11 and 12, but with the body in an assembled condition with respect to the shaft.

FIGS. 11-13 show an exploded perspective front view, in different stages of assembly, of arrowhead 20 according to another embodiment of this invention. When the embodiment shown in FIG. 13 is in the assembled condition, shaft portion 35 does not extend beyond end portion 29 of body 24. However, in another embodiment of this invention, it is possible for shaft portion 35 to extend beyond end portion 29 of body 24, and in such embodiment, tip portion 45 accommodates each retainer 50, such as discussed with respect to the embodiments of FIGS. 1-10.

In the embodiments shown in FIGS. 11-13, body 24 and each blade 70 forms a unitary structure. At least one blade 70, three as shown in FIGS. 11-13, forms the unitary structure. The unitary structure can be manufactured using any suitable manufacturing process, including metal injection molding, casting, forging, machining, such as from wrought steel and/or extruding. The particular manufacturing process and materials used can be varied depending upon the purpose for which arrowhead 20 is designed.

In the assembled condition of arrowhead 20 of FIGS. 11-13, retainer 50 is mounted within bore 23 of body 24, as previously discussed in this specification. Projection 52 of retainer 50 extends within retention groove 37 of shaft portion 35, to limit longitudinal movement of body 24 with respect to shaft 30.

Although not shown in FIGS. 11-13, in one embodiment of this invention, bias element 40, such as washer 41, can be mounted about shaft 30, between shoulder 33 and rearward end 27 of body 24. As previously discussed, when compressed, bias element 40 urges body 24 in a forward direction to remove or take up play between elements of arrowhead 20.

Figure 23:
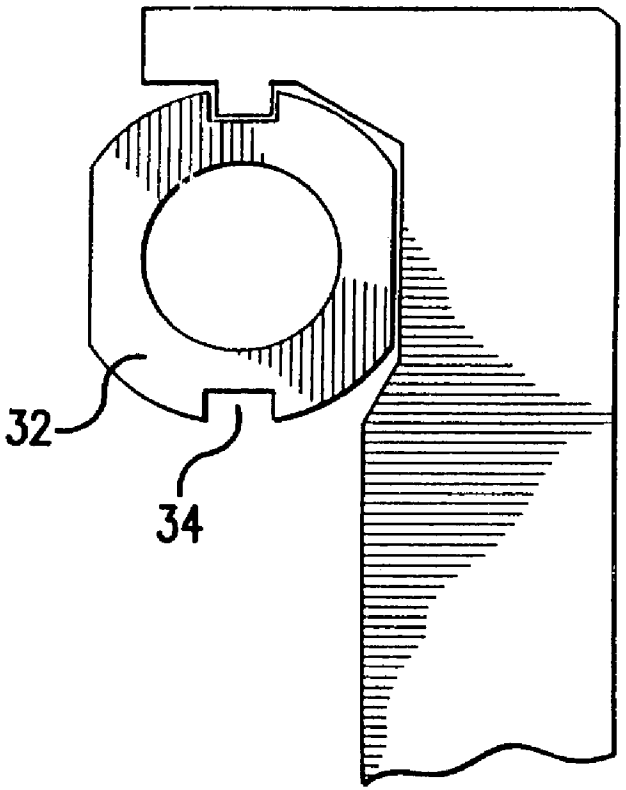
FIG. 23 is a diagrammatic view of an installation tool, according to another embodiment of this invention.
Figure 22:
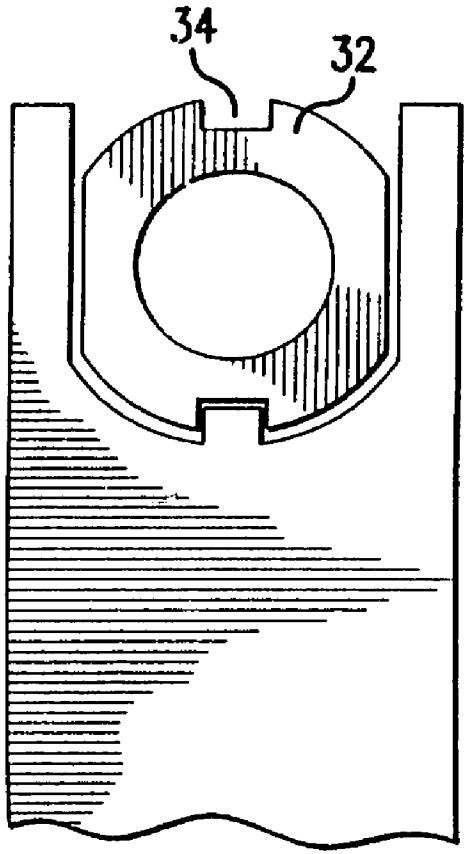
FIG. 22 is a diagrammatic view of an installation tool, according to one embodiment of this invention.
Figure 24:
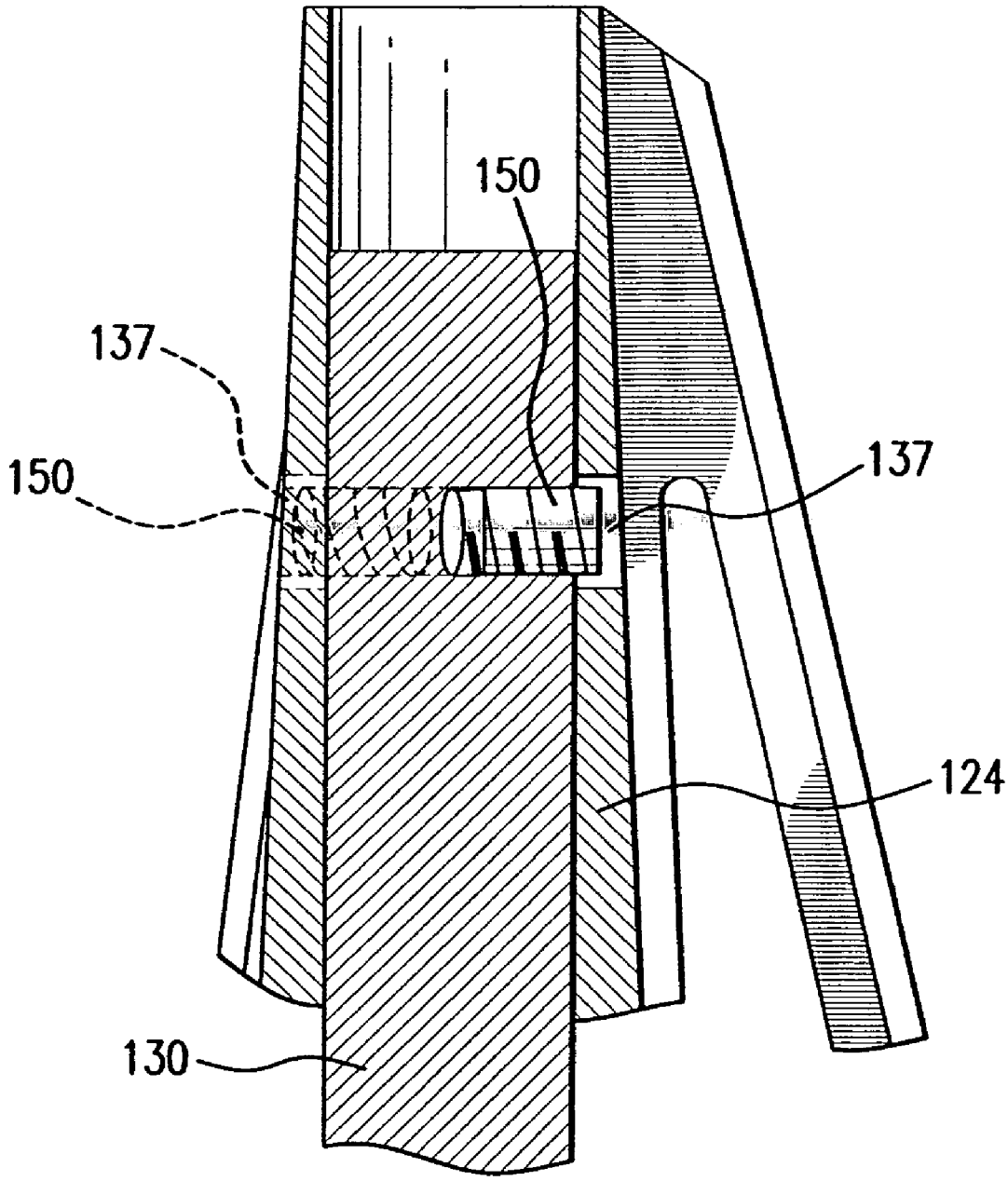
FIG. 24 is an exploded perspective front view of an arrowhead assembly, according to another embodiment of this invention.

As shown in FIGS. 11-13, shoulder 33 is formed by collar 32. However, in other embodiments of this invention, shoulder 33 can be formed by any other suitable structure which is attached with respect to or integrated with shaft 30, and shoulder 33 can be formed through or as a groove structure. As shown in FIGS. 11-14, collar 32 also has recess 34 which can be used to rotate shaft 30 with respect to an arrow shaft or an arrow shaft insert. FIGS. 22 and 23 each show a diagrammatic view of a tool, such as a wrench, that can be used to torque collar 32 and thus shaft 30. Also as shown in FIGS. 11 and 12, collar 32 has at least one flat surface that forms contact with corresponding flat surfaces of the tools shown in FIGS. 22 and 23.

In the embodiment of arrowhead 20 as shown in FIGS. 11-13, tip portion 45 has shaft 49 that mates within bore 26 of body 24. In one embodiment of this invention, an adhesive is used to secure tip portion 45 with respect to body 24. In another embodiment of this invention, bore 26 and shaft 49 have non-circular cross sections that correspond to each other, to prevent tip portion 45 from rotating with respect to body 24. Body 24 and tip portion 45 can be formed as an integral or one-piece structure, and bore 26 can be a full through bore or a closed bore. Any other suitable structural fastener can be used to fix the relative position of tip portion 45 with respect to body 24, for example a set screw can be threadedly engaged within an internally threaded bore of body 24.

In another embodiment of this invention as shown in FIGS. 11-13, tip portion 45 can be mounted to rotate with respect to body 24. For example, shaft 49 can have a retention groove, structurally similar to retention groove 37 of shaft portion 35. Retainer 50 can be positioned with respect to body 24 so that projection 52 is mounted within the retention groove of shaft 49.

Figure 14:
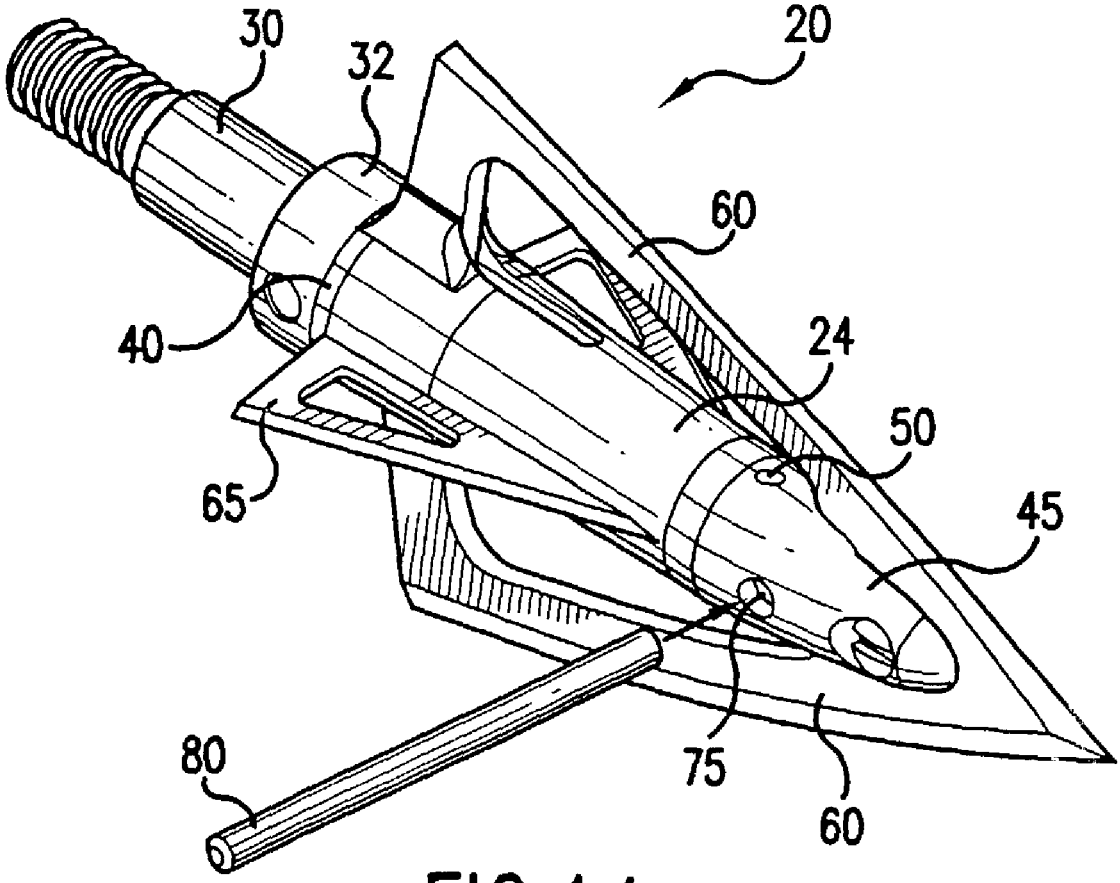
FIG. 14 is a perspective front view of an assembled rotatable arrowhead, according to another embodiment of this invention.
Figure 15:
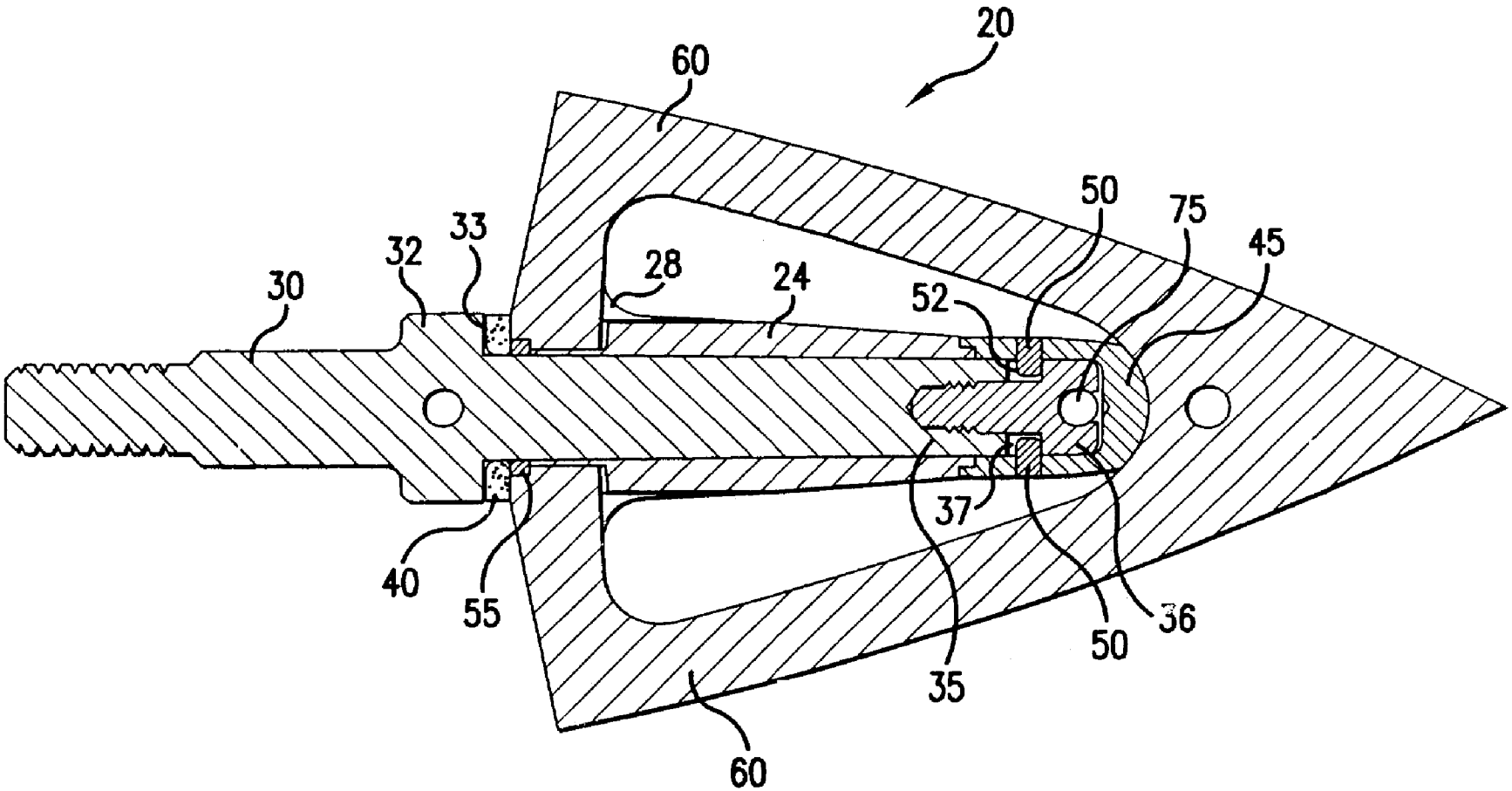
FIG. 15 is a sectional view, taken along a longitudinal axis of the rotatable arrowhead shown in FIG. 14.
Figure 16:
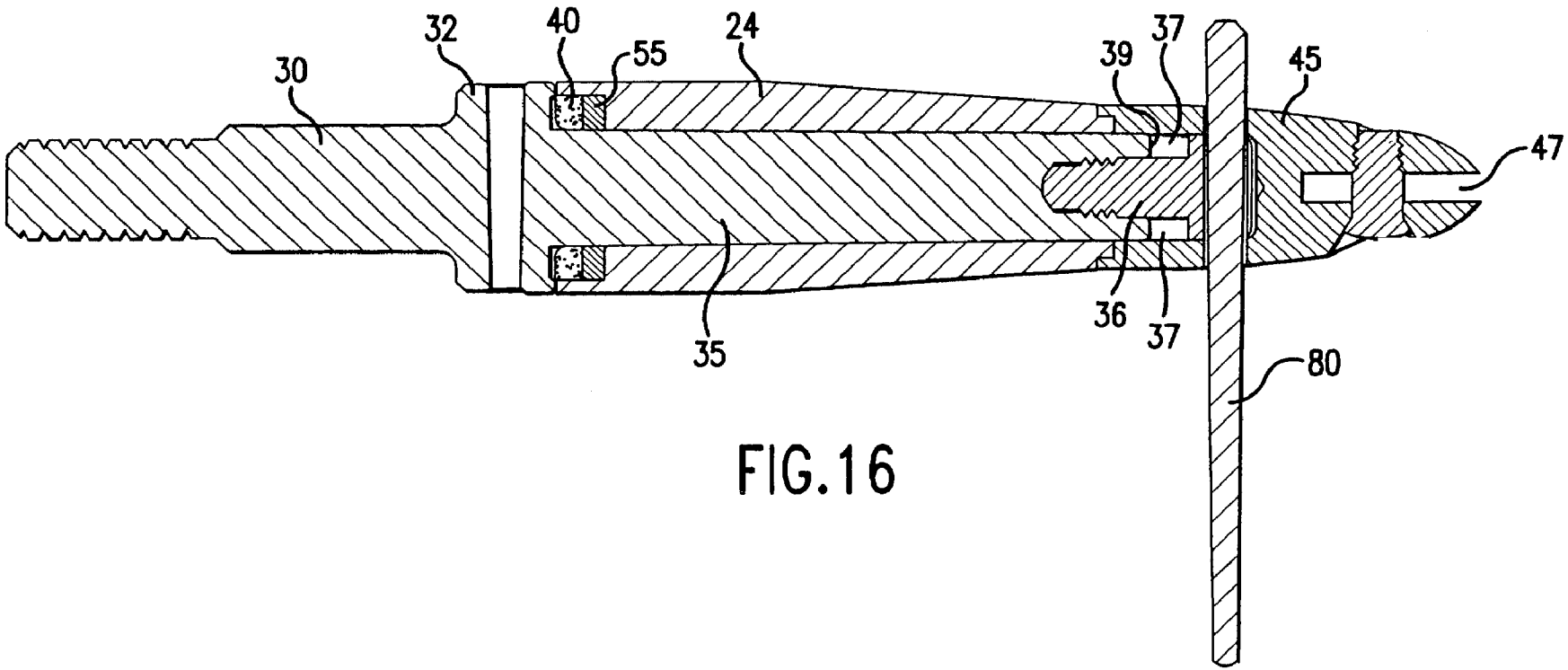
FIG. 16 is a sectional view of the rotatable arrowhead, rotated by 90° about the longitudinal axis with respect to the view shown in FIG. 15, without the blade but with an inserted tool, according to the embodiment as shown in FIG. 14.

FIGS. 14-16 show an assembled rotatable arrowhead 20, according to another embodiment of this invention. As shown between FIGS. 14 and 16, tool 80 can be inserted within access opening 75. As shown in FIG. 16, tool 80 also extends through an opening of insert 36, which is shown as a screw element, between FIGS. 15-21.

As shown in FIGS. 15-21, insert 36 can be threadedly engaged within a threaded bore of shaft portion 35. As shown in FIG. 16, retention groove 37 is formed between a head portion of insert 36 and end surface 39 of shaft 30. However, it is apparent that insert 36 can also be shaped or configured to form a plurality of retention grooves 37, in combination with or without end surface 39. FIG. 15 shows two retainers 50, each having projection 52 positioned within retention groove 37.

Tool 80 can be inserted within access opening 75, such as in the direction shown by the arrow in FIG. 14. With tool 80 within access opening 75 and a slot or other opening of insert 36, as shown in FIG. 16, tool 80 can be rotated or otherwise operated to rotate tip portion 45 and/or body 24 with respect to shaft 30. This arrangement can expedite exchange or replacement of body 24, tip portion 45 and/or blade 60. When using tool 80 to rotate tip portion 45 and insert 36 with respect to shaft portion 35, the connection between insert 36 and shaft portion 35, for example the screw connection shown in FIG. 16, can quickly connect or disconnect tip portion 45 and insert 36 with respect to shaft portion 35. Tip portion 45 and body 24 can rotate together or separate from each other. When blade 60 is in an assembled condition, for example such as shown in FIGS. 14 and 15, tip portion 45 and body 24 can rotate together. It is apparent that any other suitable mechanical connection in addition to, or in lieu of, the threaded connection between insert 36 and shaft portion 35 can be used to connect tip portion 45 and/or insert 36 with respect to tip portion 35.

Figure 18:
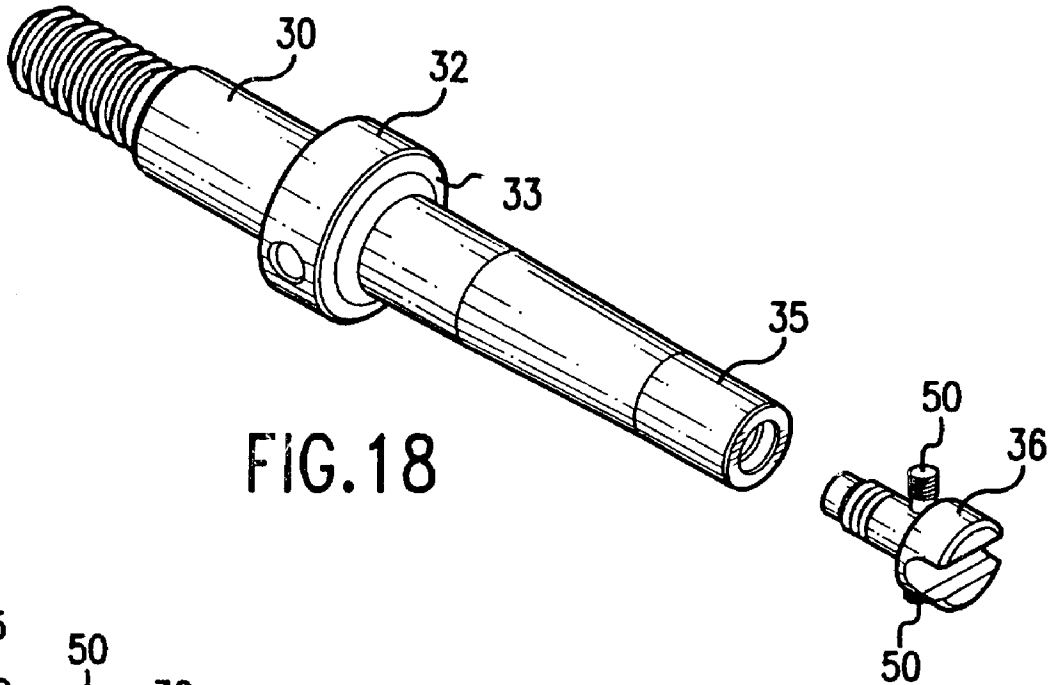
FIG. 18 is a perspective exploded view of the shaft and insert assembly, as shown in FIG. 17.
Figure 17:
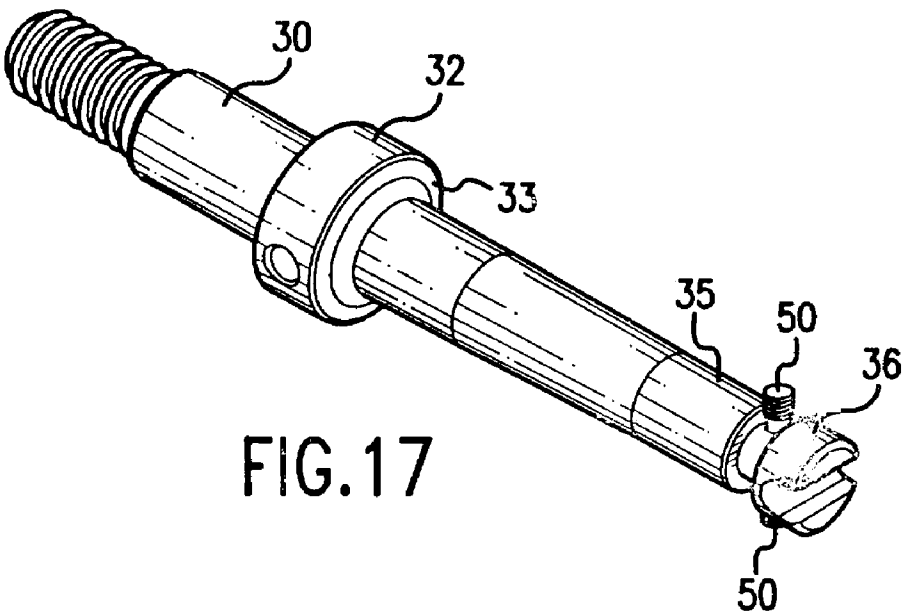
FIG. 17 is a perspective view of a shaft and insert assembly, according to one embodiment of this invention.
Figure 19:
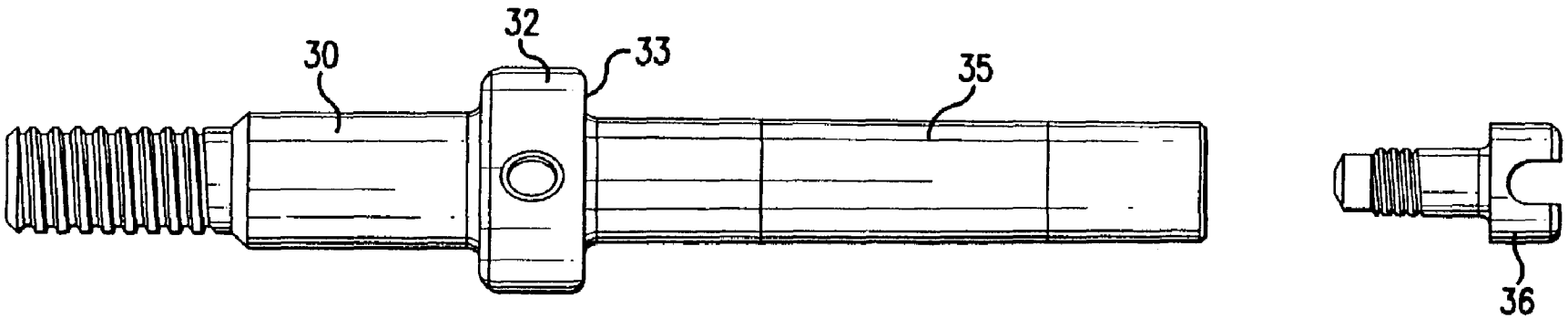
FIG. 19 is an exploded front view of the shaft and insert assembly, as shown in FIGS. 17 and 18.
Figure 20:
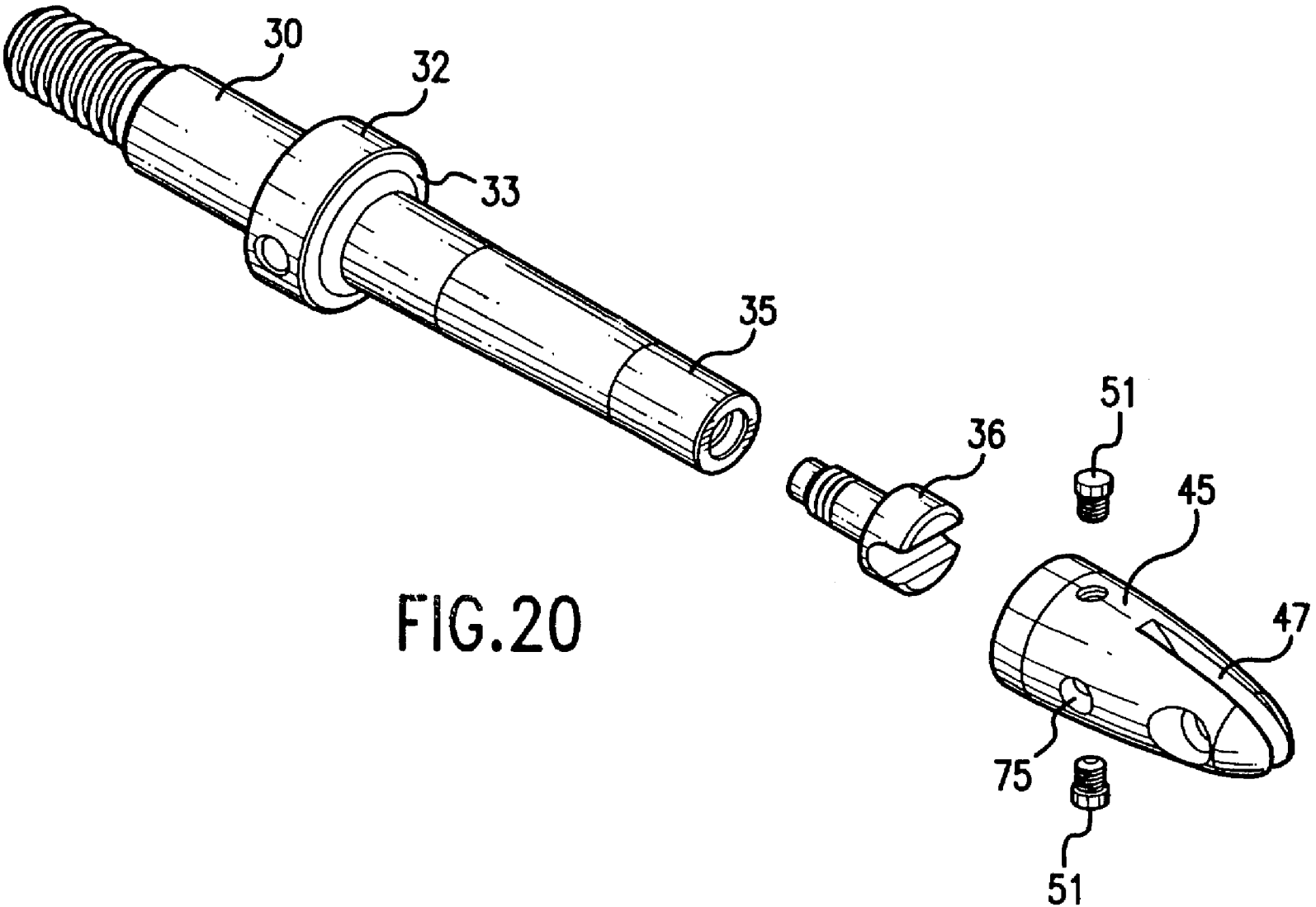
FIG. 20 is an exploded perspective view of a shaft, an insert and a tip assembly, according to one embodiment of this invention.
Figure 21:
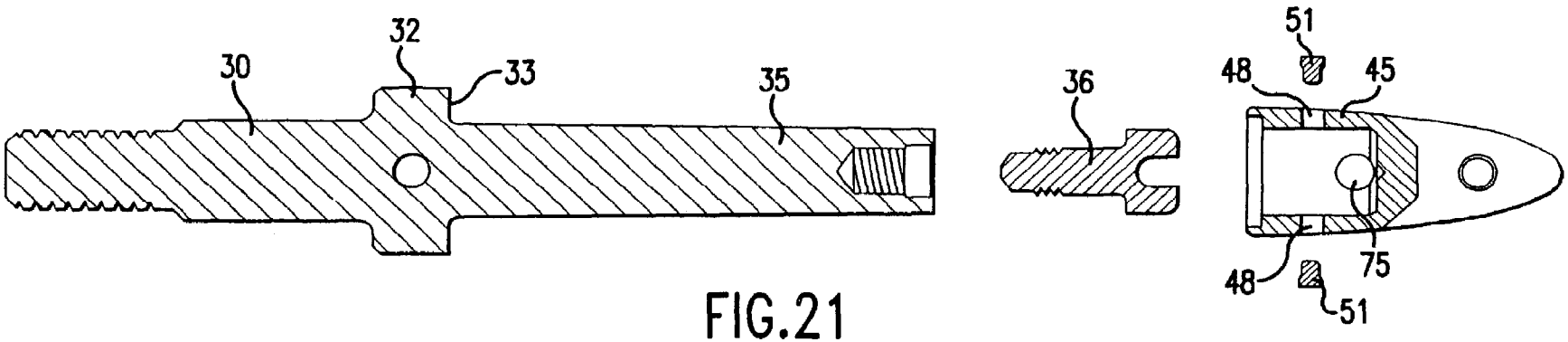
FIG. 21 is an exploded sectional view taken along a longitudinal axis, of the shaft, the insert and the tip assembly, as shown in FIG. 20.

FIGS. 17 and 18 show insert 36 connected and disconnected, respectively, with respect to shaft portion 35. FIG. 19 shows a front view of insert 36 disassembled with respect to shaft portion 35. FIGS. 20 and 21 show exploded views of shaft 30, insert 36 and tip portion 45, according to one embodiment of this invention.

The elements of this invention can be constructed of any suitable metal material, non-metal material, or any composite material. Different suitable materials for arrowhead construction are known to those skilled in the art of arrowhead design, construction and manufacture.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, and a bias element positioned with respect to said shaft to urge said body toward said tip.

2. The rotatable arrowhead according to claim 1, wherein said bias element comprises a washer positioned about said shaft between a shoulder fixed with respect to said shaft and a rearward end of said body.

3. The rotatable arrowhead according to claim 2, wherein said washer is constructed of a compressible material.

4. The rotatable arrowhead according to claim 2, wherein said washer is a wave washer.

5. The rotatable arrowhead according to claim 1, wherein said through bore is positioned along a longitudinal axis of said body.

6. The rotatable arrowhead according to claim 5, wherein in a direction perpendicular to said longitudinal axis said through bore has a circular cross section.

7. The rotatable arrowhead according to claim 6, wherein said body is a cartridge.

8. The rotatable arrowhead according to claim 1, wherein at least a portion of said shaft is cylindrical.

9. The rotatable arrowhead according to claim 1, wherein an outer diameter of at least a portion of said shaft is sized relative to an inner diameter of said through bore to allow said body to freely rotate about said shaft.

10. The rotatable arrowhead according to claim 1, wherein said tip is rotatable with respect to said body.

11. The rotatable arrowhead according to claim 1, wherein said peripheral retention groove is completely about said periphery of said shaft portion.

12. The rotatable arrowhead according to claim 1, wherein a collar is fixed with respect to said shaft and forms a shoulder.

13. The rotatable arrowhead according to claim 1, further comprising a blade detachably mounted with respect to said body and said tip.

14. The rotatable arrowhead according to claim 13, wherein a rearward end portion of said blade is spaced at a distance from a shoulder that is fixed with respect to said shaft.

15. The rotatable arrowhead according to claim 14, wherein a collar is fixed with respect to said shaft and forms said shoulder.

16. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, said tip having at least one tip through bore, said retainer comprising a pin mounted within one of said at least one tip through bore, a portion of said pin interfering with said shaft to limit longitudinal movement of said tip with respect to said shaft, and said pin being a set screw having screw threads engageable with internal threads of said at least one tip through bore.

17. The rotatable arrowhead according to claim 16, wherein said pin is cylindrical.

18. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, and said retainer comprising a projection extending from a surface of said tip.

19. The rotatable arrowhead according to claim 18, wherein said projection is integrated with said tip.

20. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, and an end surface of said shaft portion spaced a distance from a stop surface of said tip.

21. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, and a retaining ring positioned about said shaft between said body and a shoulder of said shaft.

22. The rotatable arrowhead according to claim 21, further comprising a bias element positioned about said shaft between said shoulder and a rearward end of said body.

23. The rotatable arrowhead according to claim 21, wherein said retaining ring has at least one blade retaining groove.

24. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, a blade detachably mounted with respect to said body and said tip, and said blade retaining said tip in a relatively fixed position with respect to said body.

25. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, a blade detachably mounted with respect to said body and said tip, and said tip and said body rotating together with respect to said shaft.

26. A rotatable arrowhead comprising:

a body having a through bore, a shaft extending within said through bore, said shaft having a shaft portion extending beyond an end portion of said body, said shaft portion having a peripheral retention groove about at least a portion of a periphery of said shaft portion, a tip accommodating a retainer, said retainer positioned within said retention groove, a blade detachably mounted with respect to said body and said tip, and said tip having a first slot, said body having a second slot, and said blade mounted within said first slot and said second slot.

27. A rotatable arrowhead comprising:

a body having a through bore, a shaft extending within said through bore, said shaft having a shaft portion extending beyond an end portion of said body, a tip mounted with respect to said shaft portion, said tip and said body rotating together with respect to said shaft, and said blade retaining said tip in a relatively fixed position with respect to said body.

28. The rotatable arrowhead according to claim 27, further comprising a blade detachably mounted with respect to said body and said tip.

29. A rotatable arrowhead comprising:

a body having a through bore, a shaft extending within said through bore, said shaft having a shaft portion extending beyond an end portion of said body, a tip mounted with respect to said shaft portion, said tip and said body rotating together with respect to said shaft, a blade detachably mounted with respect to said body and said tip, said tip having a first slot, said body having a second slot, and said blade mounted within said first slot and said second slot.

30. A rotatable arrowhead comprising:

a body having a bore, a shaft, said shaft having a shaft portion positioned within said bore, a shoulder fixed in a longitudinal position with respect to said shaft, one of said shaft portion and said body having a peripheral retention groove extending about at least a portion of a periphery of said shaft portion, at least one of said body and said shaft portion accommodating a retainer, said retainer positioned within said retention groove, in an assembled condition of said body with respect to said shaft said body freely rotatable with respect to said shoulder and an insert detachably connected with respect to said shaft portion.

31. The rotatable arrowhead according to claim 30, wherein said insert comprises a threaded shaft engageable within a threaded bore of said shaft portion.

32. The rotatable arrowhead according to claim 30, wherein said tip has at least one access opening and said insert has an insert opening alignable with said at least one access opening.

33. A rotatable arrowhead comprising:

a body having a bore, a shaft, said shaft having a shaft portion positioned within said bore, a shoulder fixed in a longitudinal position with respect to said shaft, in an assembled condition of said body with respect to said shaft a tip forward of said body and said tip and said body freely rotating together with respect to said shoulder, and said body positioned with respect to said shoulder without contact therebetween.

34. A rotatable arrowhead comprising:

a body having a bore, a shaft, said shaft having a shaft portion positioned within said bore, a shoulder fixed in a longitudinal position with respect to said shaft, in an assembled condition of said body with respect to said shaft a tip forward of said body and said tip and said body freely rotating together with respect to said shoulder, and an insert detachably connected with respect to said shaft portion.

35. The rotatable arrowhead according to claim 34, wherein said insert comprises a threaded shaft engageable within a threaded bore of said shaft portion.

36. The rotatable arrowhead according to claim 34, wherein said tip has at least one access opening and said insert has an insert opening alignable with said at least one access opening.

37. The rotatable arrowhead according to claim 34, wherein said body is positioned with respect to said shoulder without contact there between.

38. A method for rotating a tip of an arrowhead with respect to a shaft of the arrowhead, the method comprising:

in an assembled condition of a body of the arrowhead with respect to the shaft, freely rotating the tip with respect to the shaft;

rotatably mounting the body having a through bore about the shaft that extends within said through bore;

fixing a shoulder with respect to a longitudinal position on said shaft; and fixing a relative position of the tip with respect to the body.

39. In the method according to claim 38, wherein a blade fixes the relative position of the tip with respect to the body.

40. In the method according to claim 38, further comprising positioning said body with respect to said shoulder without contact there between.

41. In the method according to claim 38, further comprising placing a bias element between said shoulder and said body.

42. A rotatable arrowhead comprising:

a body having a bore, a shaft, said shaft having a shaft portion positioned within said bore, a shoulder fixed in a longitudinal position with respect to said shaft, one of said shaft portion and said body having a peripheral retention groove extending about at least a portion of a periphery of said shaft portion, at least one of said body and said shaft portion accommodating a retainer, said retainer positioned within said retention groove, in an assembled condition of said body with respect to said shaft said body freely rotatable with respect to said shoulder, and said body positioned with respect to said shoulder without contact there between.

43. A rotatable arrowhead comprising:

a body having a bore, a shaft, said shaft having a shaft portion positioned within said bore, a shoulder fixed in a longitudinal position with respect to said shaft, one of said shaft portion and said body having a peripheral retention groove extending about at least a portion of a periphery of said shaft portion, at least one of said body and said shaft portion accommodating a retainer, said retainer positioned within said retention groove, in an assembled condition of said body with respect to said shaft said body freely rotatable with respect to said shoulder, and a bias element between said shoulder and said body.

44. A rotatable arrowhead comprising:

a body having a bore, a shaft, said shaft having a shaft portion positioned within said bore, a shoulder fixed in a longitudinal position with respect to said shaft, in an assembled condition of said body with respect to said shaft a tip forward of said body and said tip and said body freely rotating together with respect to said shoulder, and a bias element between said shoulder and said body.

* * * * *